US009546076B2

(12) United States Patent
Mikkonen et al.

(10) Patent No.: US 9,546,076 B2
(45) Date of Patent: Jan. 17, 2017

(54) SUSPENSION ARRANGEMENT AND GUIDE SHOE ARRANGEMENT FOR AN ELEVATOR

(71) Applicants: Janne Mikkonen, Järvenpää (FI); Martti Juurioksa, Espoo (FI); Matti Räsänen, Hyvinkää (FI)

(72) Inventors: Janne Mikkonen, Järvenpää (FI); Martti Juurioksa, Espoo (FI); Matti Räsänen, Hyvinkää (FI)

(73) Assignee: KONE Corporation, Helsinki (FI)

( * ) Notice: Subject to any disclaimer, the term of this patent is extended or adjusted under 35 U.S.C. 154(b) by 263 days.

(21) Appl. No.: 14/193,444

(22) Filed: Feb. 28, 2014

(65) Prior Publication Data

US 2014/0174859 A1 Jun. 26, 2014

Related U.S. Application Data

(63) Continuation of application No. PCT/FI2012/050809, filed on Aug. 24, 2012.

(30) Foreign Application Priority Data

Sep. 15, 2011 (FI) ..... 20115902

(51) Int. Cl.

| | |
|---|---|
| ***B66B 11/08*** | (2006.01) |
| ***B66B 7/02*** | (2006.01) |
| ***B66B 11/00*** | (2006.01) |

(52) U.S. Cl.

CPC ..... *B66B 11/08* (2013.01); *B66B 7/021* (2013.01); *B66B 7/022* (2013.01); *B66B 11/009* (2013.01); *B66B 11/0045* (2013.01)

(58) Field of Classification Search

CPC ..... B66B 7/021; B66B 7/022; B66B 11/0045; B66B 11/008; B66B 11/009; B66B 11/08

See application file for complete search history.

(56) References Cited

U.S. PATENT DOCUMENTS 684,390 A 10/1901 Venn
735,093 A 8/1903 Greenwald
(Continued)

FOREIGN PATENT DOCUMENTS

CN 1212948 A 4/1999
CN 1233583 A 11/1999
(Continued)

OTHER PUBLICATIONS

Extended European Search Report issued in EP Application No. 12832049.6, dated Apr. 9, 2015.
(Continued)

*Primary Examiner* — Minh Truong
(74) *Attorney, Agent, or Firm* — Harness, Dickey & Pierce, P.L.C.

(57) ABSTRACT

A suspension arrangement and guide shoe arrangement of an elevator, which arrangement comprises at least an elevator car and at least two compensating weights, which are for their part connected to support the elevator car by the aid of at least two suspension members, such as by the aid of ropes or belts, and also by the aid of diverting pulleys, and a hoisting machine provided with at least one traction sheave or corresponding, as well as at least two traction members, such as belts, ropes or chains, separate from the suspension members, which traction members are configured to transmit the rotational movement of the traction sheave into movement of the elevator car and of the compensating weights. There are at least four guide rails of the elevator car and they are fitted into an elevator hoistway symmetrically to each other in relation to the elevator car.

17 Claims, 4 Drawing Sheets

(56) References Cited

U.S. PATENT DOCUMENTS

Figure 1:
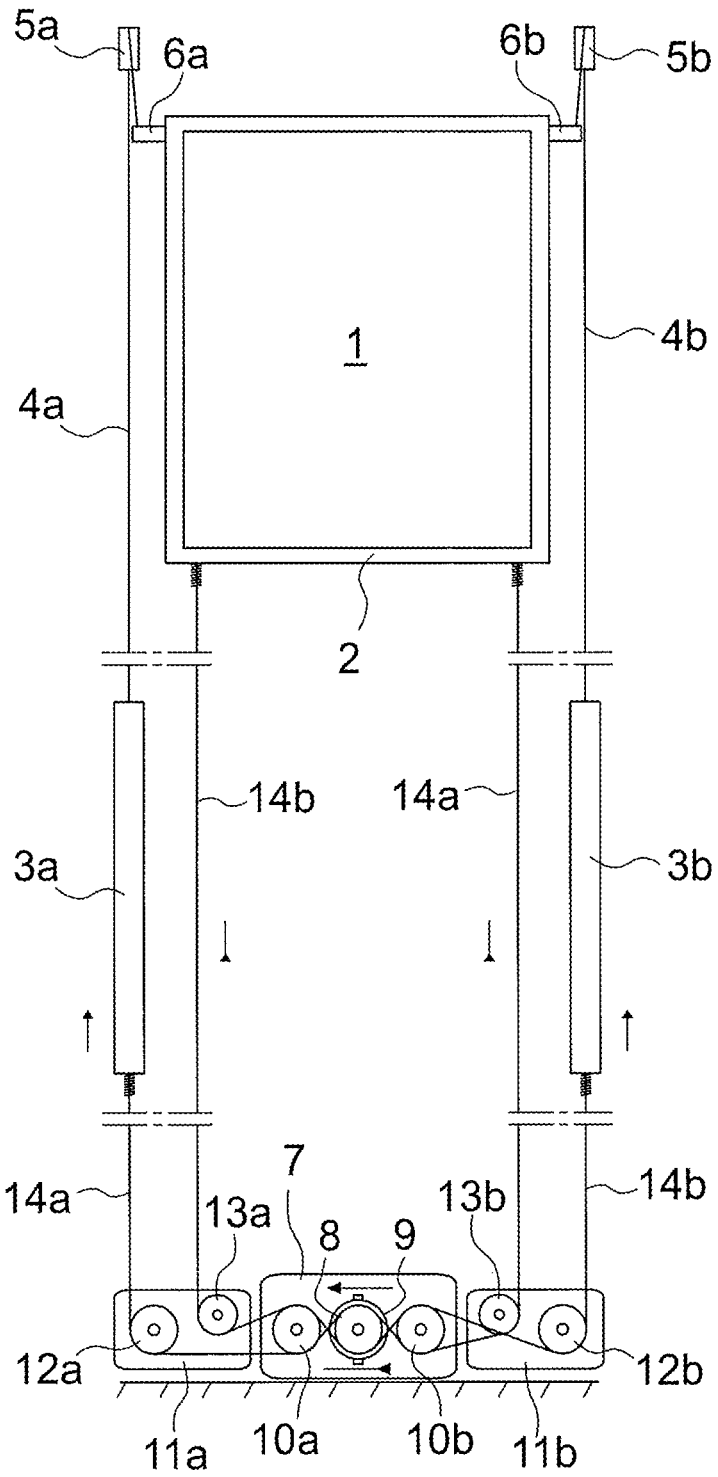

| | | | | |
|---|---|---|---|---|
| 811,513 | A | 1/1906 | MacKaye | |
| 987,384 | A | 3/1911 | Lindquist et al. | |
| 1,051,335 | A * | 1/1913 | King | B66B 7/022 187/408 |
| 1,132,769 | A * | 3/1915 | Gale, Sr. | B66B 7/062 187/264 |
| 1,566,385 | A | 12/1925 | Dunn | |
| 1,702,783 | A * | 2/1929 | Kiesling | B66B 7/022 187/404 |
| 3,174,585 | A * | 3/1965 | Tofanelli | B66B 11/009 187/264 |
| 3,845,842 | A * | 11/1974 | Johnson | B66B 17/12 187/266 |
| 5,566,783 | A * | 10/1996 | Yamashita | B66B 11/08 187/210 |
| 5,699,879 | A * | 12/1997 | Sakita | B66B 11/08 187/249 |
| 6,305,499 | B1 | 10/2001 | Jones et al. | |
| 6,364,063 | B1 | 4/2002 | Aulanko et al. | |
| 6,386,324 | B1 | 5/2002 | Baranda et al. | |
| 6,390,242 | B1 | 5/2002 | Baranda et al. | |
| 6,481,538 | B2 * | 11/2002 | Blackaby | B66B 7/021 187/254 |
| 6,491,136 | B2 * | 12/2002 | Kobayashi | B66B 11/008 187/254 |
| 6,739,433 | B1 | 5/2004 | Baranda et al. | |
| 6,848,543 | B2 * | 2/2005 | Adifon | B66B 7/02 187/254 |
| 6,851,519 | B2 | 2/2005 | Ach et al. | |
| 7,299,896 | B1 * | 11/2007 | Adifon | B66B 11/0045 187/254 |
| 7,367,430 | B2 | 5/2008 | Ach et al. | |
| 7,717,237 | B2 * | 5/2010 | Zamorano Morfin | B66B 11/008 187/264 |
| 8,157,058 | B2 * | 4/2012 | Ach | B66B 7/062 187/251 |
| 2002/0000346 | A1 | 1/2002 | Baranda et al. | |
| 2002/0000347 | A1 | 1/2002 | Baranda et al. | |
| 2004/0206579 | A1 | 10/2004 | Baranda et al. | |
| 2007/0246303 | A1 | 10/2007 | Zamorano Morfin | |
| 2009/1010777 | | 4/2009 | Baranda et al. | |
| 2014/0034425 | A1 | 2/2014 | Rasanen et al. | |
| 2014/0083802 | A1 | 3/2014 | Aulanko et al. | |

FOREIGN PATENT DOCUMENTS

| | | | |
|---|---|---|---|
| CN | 1257821 | A | 6/2000 |
| CN | 1342130 | A | 3/2002 |
| CN | 1356256 | A | 7/2002 |
| CN | 1475427 | A | 2/2004 |
| CN | 1705612 | A | 12/2005 |
| CN | 101041407 | A | 9/2007 |
| CN | 201400508 | Y | 2/2010 |
| CN | 101903278 | A | 12/2010 |
| DE | 1506479 | A1 | 12/1969 |
| DE | 102006037253 | A1 | 2/2008 |
| EP | 0905081 | A2 | 3/1999 |
| EP | 1 493 708 | A2 | 1/2005 |
| EP | 1760028 | A1 | 3/2007 |
| EP | 1097101 | B1 | 5/2007 |
| EP | 1801061 | A1 | 6/2007 |
| ES | 2161183 | A1 | 11/2001 |
| FR | 1397440 | A | 4/1965 |
| FR | 2813874 | A1 | 3/2002 |
| FR | 2823734 | | 10/2002 |
| JP | 52057644 | A | 5/1977 |
| JP | 09328270 | | 12/1997 |
| JP | 2004001912 | A | 1/2004 |
| JP | 2005-206263 | A | 8/2005 |
| JP | 2010149968 | A | 7/2010 |
| JP | 4558336 | B2 | 10/2010 |
| WO | WO-98/29327 | A1 | 7/1998 |
| WO | WO-9829326 | A1 | 7/1998 |
| WO | WO-99/43599 | A1 | 9/1999 |
| WO | WO-99/43600 | A1 | 9/1999 |
| WO | WO-9943601 | A2 | 9/1999 |
| WO | WO-03043927 | A2 | 5/2003 |

OTHER PUBLICATIONS

Chinese Office Action mailed Jun. 24, 2015.
Extended European Search Report issued in corresponding EP Application No. 12786417, dated Sep. 4, 2014.
International Search Report PCT/ISA/210 for PCT/FI2012/050450 dated Aug. 30, 2012.
Finnish Search Report for PCT/FI2012/050450 dated Feb. 27, 2012.
Written Opinion PCT/ISA/237 for PCT/FI2012/050450 dated Aug. 30, 2012.
International Search Report PCT/ISA/210 for PCT/F12012/050809 dated Nov. 13, 2012.
Written Opinion PCT/ISA/237 for for PCT/FI2012/050809 dated Nov. 13, 2012.
Finnish Search Report for Finnish Application No. 20115902 dated Jun. 28, 2012.
Chinese Office action issued in corresponding Chinese Patent Application No. 201280024140.1, dated May 5, 2015.
Chinese Office Action issued in Chinese Patent Application No. 201280024140, dated Jan. 5, 2016.
U.S. Office Action issued in U.S. Appl. No. 14/053,895, mailed Mar. 7, 2016.
Office Action issued on Sep. 9, 2016 in U.S. Appl. No. 14/053,895.

* cited by examiner

SUSPENSION ARRANGEMENT AND GUIDE SHOE ARRANGEMENT FOR AN ELEVATOR

This application is a continuation of PCT International Application No. PCT/FI2012/050809 which has an International filing date of Aug. 24, 2012, and which claims priority to Finnish patent application number 20115902 filed Sep. 15, 2011, the entire contents of both which are incorporated herein by reference.

The object of the invention is a suspension arrangement and guide shoe arrangement for an elevator.

In the suspension arrangement and guide shoe arrangement according to the invention the hoisting machine of the elevator is in the bottom part of the elevator hoistway and the suspension and traction of the elevator car are separated from each other. In this case the suspension members of the elevator car, such as the suspension ropes or suspension belts, and the traction members of the elevator car are separate from each other. This type of solution is well suited to buildings of different heights and even to elevators intended for extremely tall buildings, in which one problem is that when the location of the hoisting machine of the elevator is above, installation of the hoisting machine and peripheral structures of the elevator is awkward, expensive and even dangerous. The arrangement according to the invention is also suited to new elevators in low-rise buildings that previously had no elevator. In addition, the solution according to the invention is well suited to the modernization of old elevators.

Elevator solutions wherein the hoisting machine of the elevator is disposed on the base of the elevator hoistway, or close to the bottom part of the elevator hoistway, are known in the art. When the hoisting machine is disposed thus, the suspension ropes of the elevator cannot generally function simultaneously as the means intended for moving the elevator car, but instead separate traction ropes, traction belts or some other traction members are needed for moving the elevator car. One such prior-art solution is presented in international patent publication no. WO03/043927 A2, in which, inter alia, FIGS. 8 and 9 present suspension solutions wherein the hoisting machine of an elevator is disposed in the bottom part of the hoistway and the suspension ropes and traction ropes of the elevator car are different ropes. The elevator car and the counterweight are supported by the aid of a diverting pulley above, over which the suspension ropes fixed to the elevator car and to the counterweight pass around. Correspondingly, the moving of the elevator car is implemented with a separate toothed belt, which passes around the traction sheave of a hoisting machine below and is fixed from below between the elevator car and the counterweight. A problem in this solution is at least that the suspension of the elevator car is not in balance in relation to the center point of the elevator car. In this case additional stresses are exerted on the guide rails, support members and other hoistway structures, owing to which they must e.g. be dimensioned to be unnecessarily large. Additional stresses are produced e.g. when the load of the elevator car is not evenly distributed inside the elevator car. Another problem is that the solution is difficult to alter in relation to the layout, because one large counterweight takes so much hoistway space that flexible layouts cannot easily be used.

The aim of the present invention is to eliminate the aforementioned drawbacks and to achieve an inexpensive and easy-to-implement suspension arrangement and guide shoe arrangement, which combines the advantages of a hoisting machine disposed in the bottom part of the elevator hoistway and of flexible layout design, and which enables a type of new layout for an elevator with traction from below, by the aid of which layout the balance, producibility and space efficiency of the elevator can be improved. Another aim is to achieve a suspension arrangement and guide shoe arrangement of an elevator, which owing to its better balancing enables lighter and cheaper hoistway structures that have a longer life.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

One advantage, among others, of the solution according to the invention is that by means of it symmetrical suspension, traction and also guidance of the vertical movement of the elevator car and compensating weights are made possible in an elevator in which the suspension ropes are separated from the traction members. In this case it is easy to keep the elevator car in balance all the time, in which case additional stresses are not exerted on the hoistway structures. The invention enables the use of two or more compensating weights, which can be smaller in size than one large counterweight or compensating weight. An advantage of small compensating weights is also that the solution according to the invention is space-efficient in both the width direction and the depth direction of the elevator hoistway. Yet another advantage is that by means of the arrangement according to the invention the rope arrangements and layouts of elevators can be diversified, which enables easier layout design. Another advantage is that owing to the smaller stresses the hoistway structures can be lighter and cheaper than in prior-art solutions. Another advantage is also that disposal of the traction members on both sides of the motor shaft of the hoisting machine balances the forces on the shaft better than in prior-art solutions. Another advantage is that all the diverting pulleys in the bottom part of the elevator hoistway can be disposed on almost the same plane in the vertical direction, in which case the machine structure is very shallow.

Another advantage is also the modularized machine structure. In this case from the viewpoint of production, three modules can be created, of which the motor module is always placed in the center of the hoistway, and extension modules provided with diverting pulleys are suitably disposed on both sides of it according to the size of the hoistway, and the extension modules are fixed into their position e.g. on the bottom ends of the guide rails. Another advantage is that when the traction is on the width center line of the hoistway, the bottom safety space can be made to fit in front of the motor module opposite the motor in the depth direction of the hoistway. One advantage is also that the guide rail forces are divided between four guide rails, instead of two, in which case smaller and cheaper guide rails can be used. Yet another advantage is that the whole solution is, owing to its symmetry, easily convertible to suit different hoistway sizes, in which case finding solutions viable for production is easier.

One inventive aspect in connection with the invention is guiding the elevator car and the compensating weight—or counterweight—on shared guide rails. In other words, the tracks of the elevator car and compensating weight/counterweight are determined with guide rails, at least one guide rail, preferably more, of which is common to both the elevator car and to the compensating weight/counterweight. In this way material savings and savings in installation work are achieved.

One advantageous manifestation of the invention is that the counterweight and/or elevator car is fixed to a traction member and/or to a suspension member at two fixing points that are between the guide shoes corresponding to the guide rails. The symmetrical placement of a fixing point between the guide rails results in smaller guide shoe forces.

Figure 2:
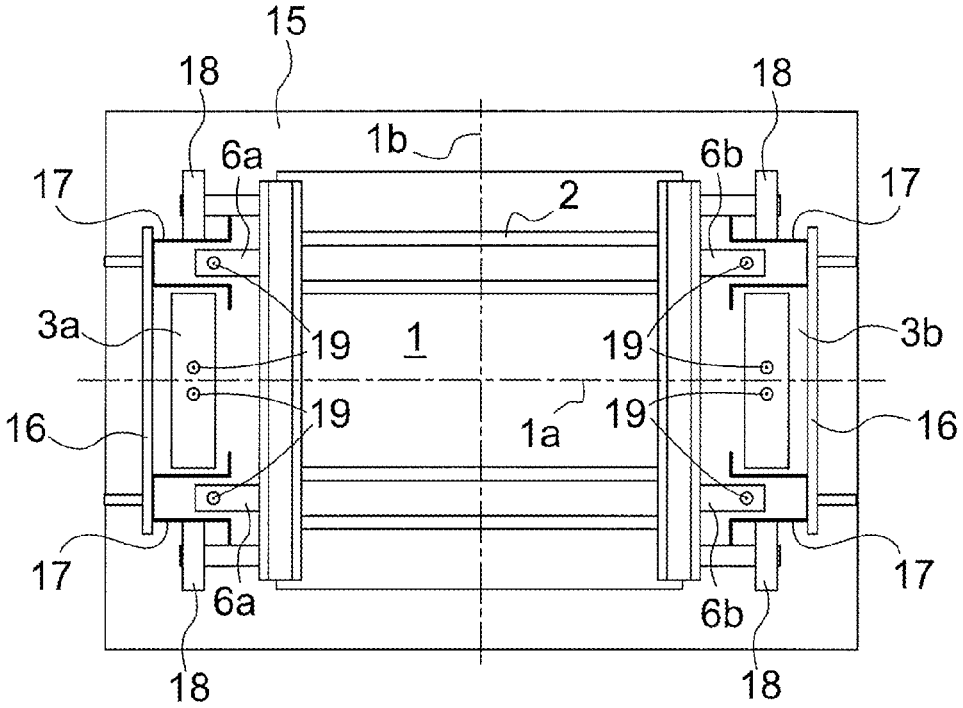
Figure 3:
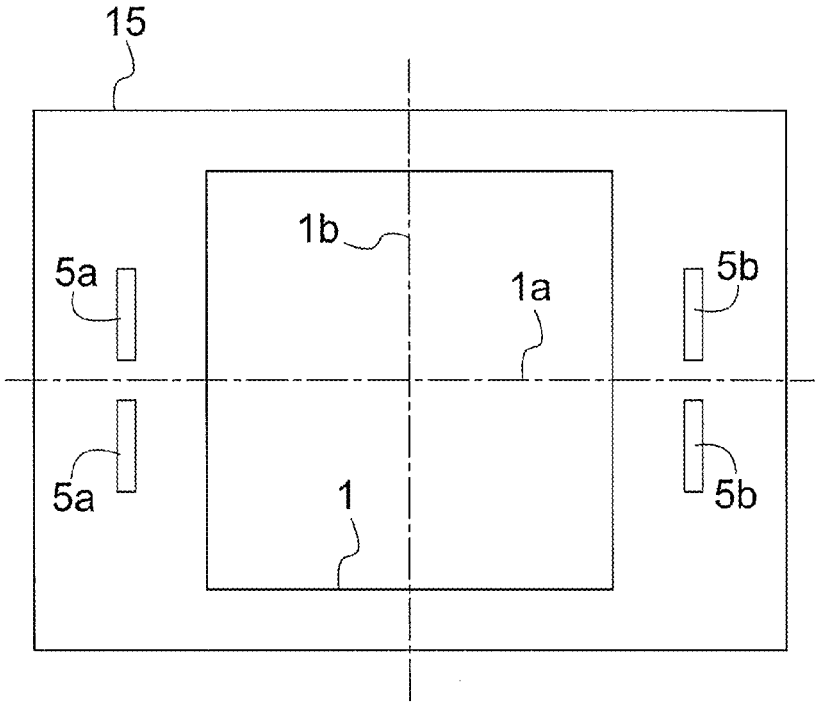
Figure 4:
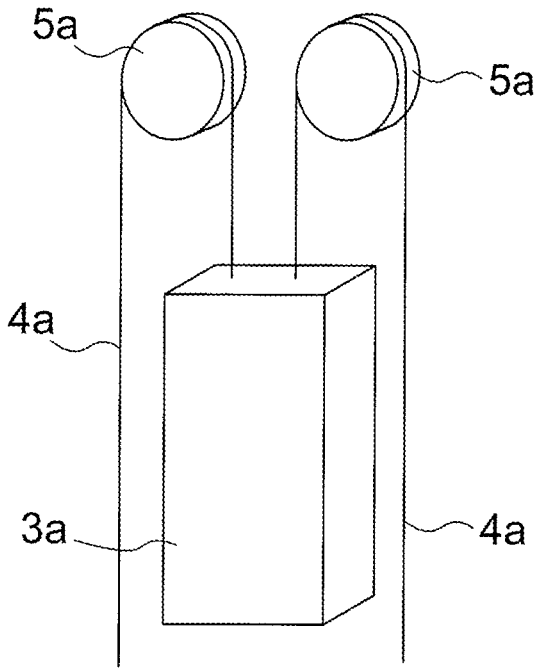
Figure 5:
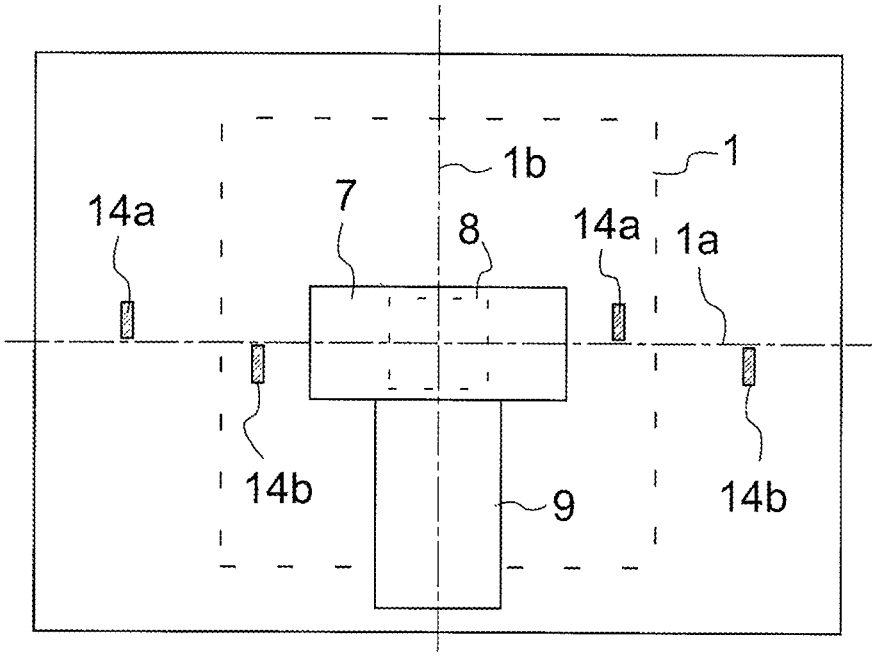
Figure 6:
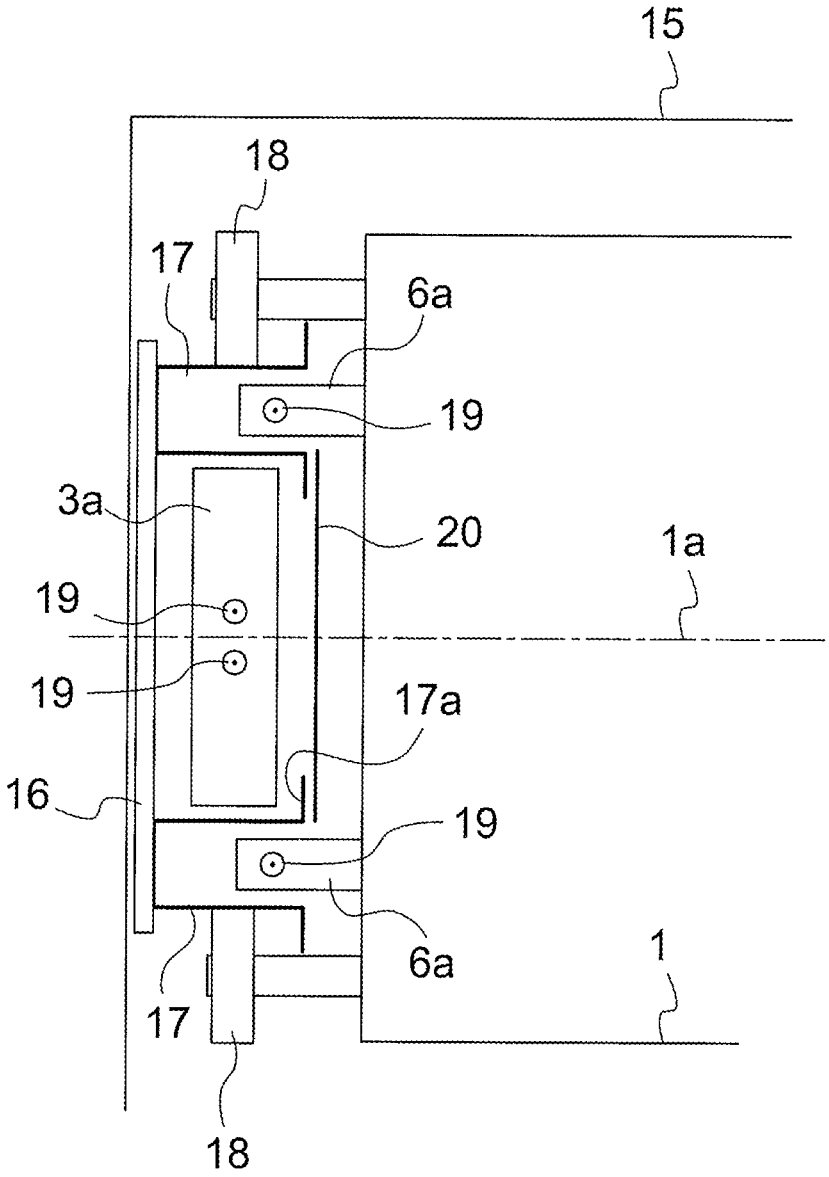

In the following, the invention will be described in detail by the aid of one example of its embodiments with reference to the simplified and diagrammatic drawings attached, wherein FIG. 1 presents a simplified and diagrammatic side view of one elevator arrangement according to the invention, FIG. 2 presents a simplified and diagrammatic top view of an elevator arrangement according to FIG. 1, FIG. 3 presents a top view of the top part of the elevator hoistway in an elevator arrangement according to FIG. 1, FIG. 4 presents an oblique side view of a suspension solution of a compensating weight in an elevator arrangement according to FIG. 1, FIG. 5 presents a top view of the bottom part of the elevator hoistway in an elevator arrangement according to FIG. 1, and FIG. 6 presents a simplified, magnified and diagrammatic top view of the guide rail structures and guide shoe structures of an elevator arrangement according to FIG. 1.

To enable the arrangement according to the invention, the elevator arrangement comprises at least an elevator car 1 configured to move up and down in an elevator hoistway and at least one or more compensating weights 3*a*, 3*b*, which are for their part connected to support the elevator car by the aid of suspension members 4*a*, 4*b*, such as belts or ropes, and also by the aid of e.g. diverting pulleys 5*a*, 5*b* mounted on bearings in the top part of the elevator hoistway. In addition, the arrangement according to the invention comprises a hoisting machine 9, provided with at least one traction sheave 8 or corresponding and disposed in the bottom part of the elevator hoistway, and at least two or more traction members 14*a*, 14*b*, such as ropes or belts, that are fully separate from the suspension members 4*a*, 4*b*, which traction members are configured to transmit the rotational movement of the traction sheave 8 into linear movement of the elevator car 1 and of the compensating weights 3*a*, 3*b*. Characteristic to the solution according to the invention, and common to all the different embodiments of the invention, is that each compensating weight 3*a*, 3*b*, or in some cases more than two compensating weights, is connected, by the aid of its own traction member 14*a*, 14*b* provided with e.g. essentially spring tensioning or constant-force tensioning, to most preferably one and the same hoisting machine 9.

FIG. 1 presents a simplified and diagrammatic side view of one elevator arrangement applicable to the solution according to the invention. The elevator arrangement according to FIG. 1 comprises two compensating weights 3*a* and 3*b* functioning as counterweights and disposed symmetrically on different sides of the elevator car 1, both of which compensating weights are connected by means of suspension members 4*a* and 4*b* to a car sling 2 fitted around the elevator car 1. One suspension member 4*a*, 4*b* can be e.g. just an individual rope, belt or chain, or it can be composed of a number of parallel members, e.g. hoisting ropes. The suspension members 4*a*, 4*b* are e.g. steel wire ropes or belts and they are fixed at their first ends to the top part of the compensating weights 3*a* and 3*b*, from where they are led upwards to pass around the top of the diverting pulleys 5*a* and 5*b* fitted in the top part of the elevator hoistway, from where onwards down to the fixing means 6*a* and 6*b* on the top part of the car sling 2, to which fixing means the suspension members 4*a*, 4*b* are fixed at their second ends.

A motor module 7 is fitted in the bottom part of the elevator hoistway, which motor module comprises at least a hoisting machine 9 arranged to move the elevator car 1 and provided with a traction sheave 8, as well as two diverting pulleys 10*a* and 10*b*. The arrangement also comprises two extension modules 11*a* and 11*b*, which are fitted at the edges of the elevator hoistway on opposite sides of the motor module 7 to each other. Both extension modules comprise at least two diverting pulleys, which are arranged to guide the traction members 14*a* and 14*b*.

The first traction member 14*a* is fixed at its first end to the bottom part of the first compensating weight 3*a*, from where it is led down to pass around the bottom of the first diverting pulley 12*a* of the first extension module 11*a*, from where onwards under the first diverting pulley 10*a* of the motor module 7, after which over the traction sheave 8. From the traction sheave 8 the first traction member 14*a* is led to pass around the bottom of the second diverting pulley 10*b* of the motor module 7, from where onwards under the second diverting pulley 13*b* of the second extension module 11*b*, after passing around the bottom of which diverting pulley 13*b* the traction member 14*a* is led up to the car sling 2, to the bottom part of which the first traction member 14*a* is fixed e.g. via a fixing means provided with e.g. spring tensioning or constant-force tensioning.

The second traction member 14*b* is, for its part, fixed at its first end to the bottom part of the second compensating weight 3*b*, from where it is led down to pass around the bottom of the first diverting pulley 12*b* of the second extension module 11*b*, from where onwards over the second diverting pulley 10*b* of the motor module 7, after which under the traction sheave 8. From the traction sheave 8 the second traction member 14*b* is led to pass around the top of the first diverting pulley 13*a* of the motor module 7, from where onwards under the second diverting pulley 13*a* of the first extension module 11*a*, after passing around the bottom of which diverting pulley 13*a* the traction member 14*b* is led up to the car sling 2, to the bottom part of which the second traction member 14*b* is fixed e.g. via a fixing means provided with e.g. spring tensioning or constant-force tensioning.

In the situation according to FIG. 1, the traction sheave 8 rotates in the direction of the arrows drawn above and below the traction sheave, in which case the elevator car 1 moves downwards and the compensating weights 3*a* and 3*b* move upwards.

FIG. 2 presents a simplified and diagrammatic top view of an elevator arrangement according to FIG. 1. The elevator car 1 is fitted inside the car sling 2. Essentially vertical guide rails 17 are fixed by the aid of clamps 16 to the side walls of the elevator hoistway 15, guided by which guide rails the elevator car 1 is arranged to travel up and own in the hoistway 15. On both sides of the elevator car 1 are two guide rails 17 that are essentially similar to each other and are fitted symmetrically with respect to each other and to the elevator car 1. In this case the guide rails 17 are disposed symmetrically as viewed from above in relation both to the depth center line 1*a* of the elevator car running through the center point of the elevator car 1 and to the width center line 1*b* of the elevator car running through the center point of the elevator car 1.

Compensating weights 3*a*, 3*b* are fitted between the guide rails 17 on both sides of the elevator car 1, at least one compensating weight each side of the elevator car 1, which compensating weights 3*a*, 3*b* are configured to travel in the hoistway 15 resting on the first outer surfaces, which are opposite each other, of the guide rails 17. In FIG. 2 the compensating weights 3*a*, 3*b* are, however, for the sake of clarity presented as slightly detached from the aforementioned outer surfaces, which are opposite to each other, of the guide rails 17. Correspondingly the elevator car 1 is configured to rest, by the aid of roller guide shoes 18 fixed to the car sling 2, on the second outer surfaces of the guide rails 17, which surfaces point away from each other.

The suspension members 4*a*, 4*b* of the elevator car 1 are arranged to be fixed at their first ends to the top parts of the compensating weights 3*a*, 3*b* and at their second ends to the fixing means 6*a*, 6*b* on the car sling 2. The fixing points of the suspension members 4*a*, 4*b* are marked in the figure with the number 19. As is seen from FIG. 2, the suspension and the guidance of the vertical movement of the elevator car 1 is implemented symmetrically with respect to the center lines 1*a* and 1*b*, in which case no additional stresses or strains are exerted e.g. on the guide rails 17 and other hoistway structures.

FIG. 3 presents a simplified and diagrammatic top view of the top part of the elevator hoistway 15. Diverting pulleys 5*a* and 5*b* are fitted in the top part of the elevator hoistway 15 on opposite sides of the elevator car 1 in the lateral direction. In this embodiment on the first side of the elevator car 1 above the elevator car 1 and on the side of the travel profile of the elevator car 1 are two first diverting pulleys 5*a* symmetrically on different sides of the depth center line 1*a* of the elevator car. Correspondingly, on the second side of the elevator car 1 above the elevator car 1 and on the side of the travel profile of the elevator car 1 are two second diverting pulleys 5*b* symmetrically on different sides of the depth center line 1*a* of the elevator car 1. In addition the diverting pulleys 5*a* and 5*b* are disposed symmetrically to each other in relation to the width center line 1*b* of the elevator car 1. The suspension members 4*a*, 4*b* of the elevator car 1 are led over the diverting pulleys 5*a*, 5*b* from the compensating weights 3*a*, 3*b* to the elevator car 1, as is already described in the descriptive part of FIG. 1.

FIG. 4 presents an oblique view from the side and top of a suspension arrangement of the compensating weights of the elevator arrangement presented above. FIG. 4 presents only the first compensating weight 3*a*, because the second compensating weight 3*b* is suspended in the same way. In the situation according to FIG. 1, the elevator car 1 is in its bottom position and the compensating weights 3*a* and 3*b* are in their top position near the diverting pulleys 5*a* and 5*b*. The first suspension members 4*a*, which are thus at least two belts, ropes or two pluralities of parallel ropes, leaving from the compensating weight 3*a* each pass around the top of their own diverting pulley 5*a* and then descend to their fixing points 19 on the elevator car 1. The suspension members 4*b* on the second side of the elevator car 1 are suspended in a corresponding manner.

FIG. 5 presents a simplified and diagrammatic top view of the bottom part of the elevator hoistway 15. For the sake of clarity, in FIG. 5 the diverting pulleys in the bottom part of the hoistway are not presented, and the traction members 14*a* and 14*b* are presented as cross-sections. The traction members 14*a* and 14*b* are preferably e.g. toothed belts, which are configured to travel a part of the distance parallel with each other and symmetrically to each other on both sides of the depth center line 1*a* of the elevator car 1. In the arrangement according to FIG. 5 the traction member 14*a* is disposed on a first side of the depth center line 1*a* of the elevator car 1 and the traction member 14*b* is disposed on a second side of the depth center line 1*a* of the elevator car 1. In addition, the horizontal distances of the traction members 14*a* and 14*b* are symmetrically disposed from the width center line 1*b* of the elevator car 1.

The toothed contact surface of the traction sheave 8 is so wide that both the traction members 14*a*, 14*b* fit side-by-side onto the contact surface of the traction sheave 8 without interfering with each other. In this way one and the same hoisting machine 9 and also one and the same traction sheave 8 give to both the traction members 14*a*, 14*b* a force producing linear movement of the elevator car 1 and of the compensating weights 3*a*, 3*b*.

FIG. 6 presents a simplified, magnified and diagrammatic top view of the guide rail structures and guide shoe structures of an elevator arrangement according to FIG. 1, the structure and operation of which have been described already in conjunction with FIG. 2. For the sake of clarity, in FIG. 6 the clamps 16 are presented slightly detached from the side wall of the elevator hoistway 15, although in reality they are attached to the side wall. The guide rail 17 of the elevator car 1 is in its cross-section essentially a U-shaped beam, which opens towards the elevator car 1. In this case it has been possible to fit the fixing means 6*a*, 6*b* of the suspension members 4*a*, 4*b* on the car sling 2, and the fixing points 19 of the suspension members 4*a*, 4*b* in them, inside the web of the guide rail 17, in which case it has been possible to utilize the space in the width direction of the elevator hoistway 15 better. The compensating weights 3*a* and 3*b* disposed between the guide rails 17 are configured to travel in the hoistway 15 resting on the first outer surfaces, which are opposite each other, of the web of the guide rails 17. For the sake of clarity, the compensating weight 3*a* is presented in FIG. 6 slightly detached from the aforementioned outer surface of the guide rails 17. Correspondingly the elevator car 1 is configured to rest, by the aid of roller guide shoes 18 fixed to the car sling 2, on the second outer surfaces of the guide rails 17, which surfaces point away from each other.

Flanges, turned outwards from the web of the guide rail at a right angle with respect to the web of the guide rail 17, are additionally on the guide rail 17 on the side of the elevator car 1, of which the flanges 17*a* that point towards each other are configured as a fixing surface for an enclosure board 20, with which the compensating weight 3*a*, 3*b* is enclosed in its own enclosure. Good enclosing reduces the noise disturbance when, inter alia, the elevator car 1 and the compensating weights 3*a*, 3*b* meet each other in the elevator hoistway.

It is further characteristic to the arrangement according to the invention that the positioning point of the diverting pulleys 5*a*, 5*b* disposed in the top clearance of the elevator hoistway 15 is configured such that the elevator car 1 can rise past the diverting pulleys 5*a*, 5*b* in the top end of the elevator hoistway 15 right to the top end of the elevator hoistway 15. In this way the most space-efficient layout solution possible is also achieved in the top end of the elevator hoistway 15.

It is obvious to the person skilled in the art that the invention is not limited solely to the examples described above, but that it may be varied within the scope of the claims presented below. Thus, for example, the suspension solutions can also be different to what is presented above.

It is further obvious to the person skilled in the art that the location of the hoisting machine can be elsewhere than what is presented above. The hoisting machine can be on the base of the elevator hoistway, or close to the base, but also on some side of the elevator hoistway and also in the top part of the elevator hoistway.

It is also obvious to the person skilled in the art that the number of compensating weights can also be greater than two. There can be e.g. three, four, six, eight, ten or even more compensating weights disposed in a different manner.

The invention claimed is:

1. A suspension and guide shoe arrangement for an elevator, the arrangement comprising:

at least four guide rails in an elevator hoistway, the at least four guide rails being arranged symmetrically to one another relative to an elevator car configured to move along the at least four guide rails;

at least two compensating weights configured to support the elevator car via at least two suspension members and diverting pulleys; and a hoisting machine including at least one traction sheave and at least two traction members, the at least two traction members being separate from the at least two suspension members, and the at least two traction members being configured to move the elevator car and the at least two compensating weights in the elevator hoistway, wherein the hoisting machine is arranged in a lower part of the elevator hoistway, a first of the at least two suspension members is fixed to an upper part of the elevator car and to an upper part of a first of the at least two compensating weights, and a first of the at least two traction members is fixed to a bottom of the elevator car and to a lower part of the first of the at least two compensating weights, the first of the at least two compensating weights is arranged at a first side of the elevator car in the elevator hoistway, and the first of the at least two traction members is fixed to the bottom of the elevator car at a second side of the elevator car, the second side being opposite to the first side.

2. The suspension and guide shoe arrangement according to claim 1, wherein the at least four guide rails are arranged symmetrically relative to a depth center line and a width center line of the elevator car.

3. The suspension and guide shoe arrangement according to claim 1, wherein at least two of the at least four guide rails are arranged at opposite sides of the elevator car.

4. The suspension and guide shoe arrangement according to claim 1, wherein:

the first of the at least two compensating weights is suspended in connection with the elevator car by the first of the at least two suspension members;

a second of the at least two compensating weights is arranged at the second side of the elevator car, the second of the at least two compensating weights being suspended in connection with the elevator car by a second of the at least two suspension members;

the first and second of the at least two suspension members are separate from one another; and the first and second of the at least two suspension members are arranged at different sides relative to a depth center line of the elevator car.

5. The suspension and guide shoe arrangement according to claim 1, wherein the at least two compensating weights are arranged at different sides relative to a depth center line and a width center line of the elevator car.

6. The suspension and guide shoe arrangement according to claim 1, wherein:

the diverting pulleys are arranged at a top part of the elevator hoistway, each of the diverting pulleys corresponding to a suspension member from among the at least two suspension members.

7. The suspension and guide shoe arrangement according to claim 1, wherein the at least two traction members are configured to travel at least part of a distance in parallel with one another at different sides relative to a depth center line of the elevator car.

8. The suspension and guide shoe arrangement according to claim 1, wherein vertical parts of the at least two traction members are arranged at a same horizontal distance from a width center line of the elevator car.

9. The suspension and guide shoe arrangement according to claim 1, wherein:

the at least two compensating weights are arranged in an enclosure; and walls of the enclosure include guide rails, from among the at least four guide rails, arranged at different sides relative to a depth center line of the elevator car.

10. The suspension and guide shoe arrangement according to claim 1, wherein at least one of the at least four guide rails is common to a track of the elevator car and a compensating weight among the at least two compensating weights.

11. The suspension and guide shoe arrangement according to claim 1, wherein a fixing point of at least a first one of the at least two traction members is between two of the at least four guide rails.

12. The suspension and guide shoe arrangement according to claim 1, wherein a fixing point of at least one of the at least two suspension members is between two of the at least four guide rails.

13. The suspension and guide shoe arrangement of claim 1, wherein the at least two suspension members are one of suspension ropes and suspension belts.

14. The suspension and guide shoe arrangement of claim 13, wherein the at least two traction members are one of ropes, belts and chains.

15. The suspension and guide shoe arrangement of claim 1, wherein the at least two traction members are one of ropes, belts and chains.

16. The suspension and guide shoe arrangement of claim 1, wherein the at least two suspension members are separated from the at least two traction members by the at least two compensating weights.

17. The suspension and guide shoe arrangement of claim 1, wherein:

the first of the at least two suspension members is fixed to the upper part of the elevator car, passes around a first of the diverting pulleys, and is fixed to the upper part of the first of the at least two compensating weights; and the first of the at least two traction members is fixed to the bottom of the elevator car, passes around a second of the diverting pulleys and the traction sheave, and is fixed to the lower part of the first of the at least two compensating weights.

* * * * *